United States Patent [19]

Jullien et al.

[11] Patent Number: 4,531,797

[45] Date of Patent: Jul. 30, 1985

[54] ELECTRICAL CONNECTION DEVICE WITH READY-ACCESS PROTECTED TERMINALS

[75] Inventors: Claude Jullien, Thenezay; Gérard Lerude, Poitiers, both of France

[73] Assignee: La Telemecanique Electrique, Nanterre, France

[21] Appl. No.: 466,199

[22] Filed: Feb. 14, 1983

[30] Foreign Application Priority Data

Feb. 12, 1982 [FR] France ..... 82 02354

[51] Int. Cl.[3] ..... H01R 11/00; H01R 9/00

[52] U.S. Cl. ..... 339/61 M; 339/198 J; 339/210 M; 339/220 R

[58] Field of Search ..... 339/59 M, 59 R, 61 M, 339/61 R, 198 R, 198 J, 210 M, 210 R, 220 R

[56] References Cited

U.S. PATENT DOCUMENTS 2,740,001 3/1956 Vergilio et al. ..... 339/198 J
2,985,861 5/1961 Rogoff et al. ..... 339/61 M
3,354,454 11/1967 Rueger ..... 339/208

FOREIGN PATENT DOCUMENTS 1030976 5/1966 United Kingdom ..... 339/61 R

*Primary Examiner*—Gil Weidenfeld
*Assistant Examiner*—Gary F. Paumen
*Attorney, Agent, or Firm*—William A. Drucker

[57] ABSTRACT

On at least one of two walls (16) (17) a terminal (7) housing (21) has a rib (44) respectively (45) that causes lateral distortion of a tubular housing (38) (39) which is part of a cover (3) so that the head (11) of a bolt of the terminal is gripped. This device, which is extremely simple to assemble, is recommended to make the terminal bolts so they cannot be lost and to hold them in an open position prior to wiring.

8 Claims, 6 Drawing Figures

ELECTRICAL CONNECTION DEVICE WITH READY-ACCESS PROTECTED TERMINALS

The invention relates to an electrical connection device that includes a holder with a number of neighboring housings separated by partitions and/or limited by walls parallel to the screwing axes of a number of connection terminals, each of which has a fixed internal conductor equipped with a threaded opening and a set-screw equipped with a clamp that is always under the head of the bolt; and a protective cover that hooks onto the body and has a coaxial cylindrical hole opposite each bolt head that can guide a screwing tool and maintain the bolt in a pending position where the threaded tip is inserted opposite the threaded hole.

Such devices are often used in terminal devices or in devices such as contactors or relays, to make it so that the bolts cannot be lost, and also to provide the user with a device that requires no prior unscrewing for connecting; and to complement insulating the terminals. This is partially done by the partitions.

In known devices cover holes are of a diameter smaller than that of the head of the bolt, which does not make it possible to insert them on the inside using a simple assembly procedure; and can cause disalignment of the threaded tip in comparison to the threaded hole during assembly if the bolt is not perfectly coaxial.

Therefore, the invention proposes to provide a device that meets the general above-mentioned composition, but in which steps are taken to facilitate assembly of the terminal bolts and to avoid creating significant disalignments between the latter and the threaded holes of the fixed conductors.

According to the invention, this result is attained because of the fact that the inside diameter $\phi$ of the cylindrical hole is greater than the diameter d of the bolt head. The hole is surrounded by a thin wall that can be distorted transversely, an exterior surface of the wall and a rib working together. The rib is borne by a partition and/or respectively by a wall in such a way that the bolt head can be inserted in a hole using gravity if the cover is not coupled to the body and can be pinched by this distorted wall when the cover is coupled to the body.

The invention, which will be better understood upon reading the description below, will be illustrated by six attached figures among which:

Figure 2:
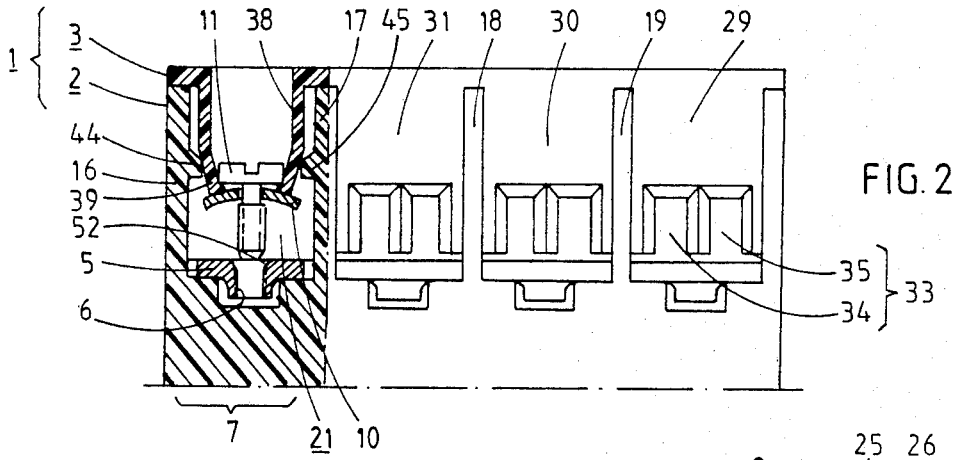
FIG. 2 represents a vertical section with a partial section of the complete device through a plane 2—2 of FIGS. 4 and 6 passing through the axis of the terminal bolts.

A connection device in accordance with the invention is brought into play in a device 1 visible in FIG. 2; it can be a terminal device, a contactor, a relay or a casing that contains electrical components connected using connection terminals that must be protected against accidental contact with foreign bodies or parts.

Figure 1:
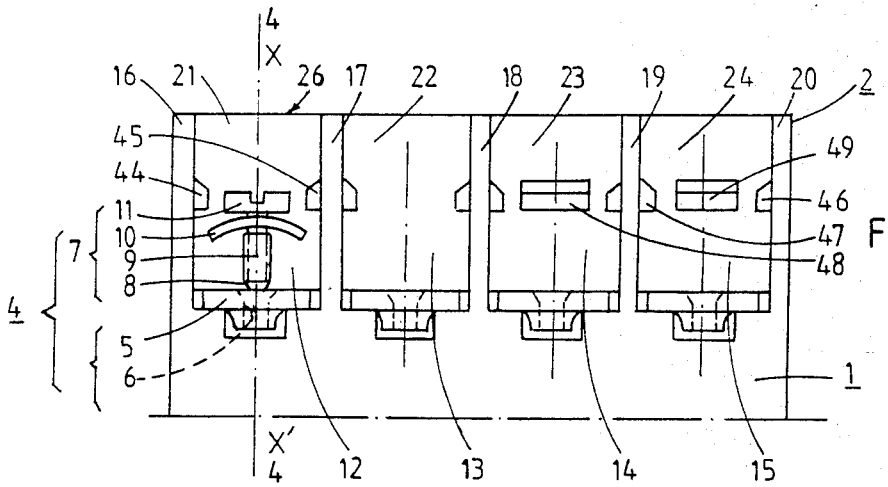
FIG. 1 shows a vertical section of a body of the device in accordance with the invention, but without its cover.

The casing 2 of the device 1 has a number of terminals in rows such as 4 (see FIG. 1). Each has a flat coonductor 5 with a threaded opening 6, a bolt 7 with a tip 8 with a threaded portion 9, and a clamp 10 that is inserted under the head 11 of the bolt and that remains in that position permanently through the use of already known means.

Each terminal such as 4 is inserted in one of a number of housings placed side by side, 12, 13, 14, 15.

Each housing is limited by parallel partitions such as 16, 17; 17, 18; 18, 19; 19, 20; and by walls 21, 22, 23, 24. The walls and partitions are parallel or respectively largely parallel to axes XX' of the bolts which are parallel among themselves as well.

To make it possible to connect the device quickly, the terminals must be handed to the user in an open position and the bolts must be the type that cannot be lost. This result is attained if each bolt 7 of a terminal 4 is kept in a position that can be seen in FIGS. 1 and 2. This is obtained using a lid or cover 3.

Figure 6:
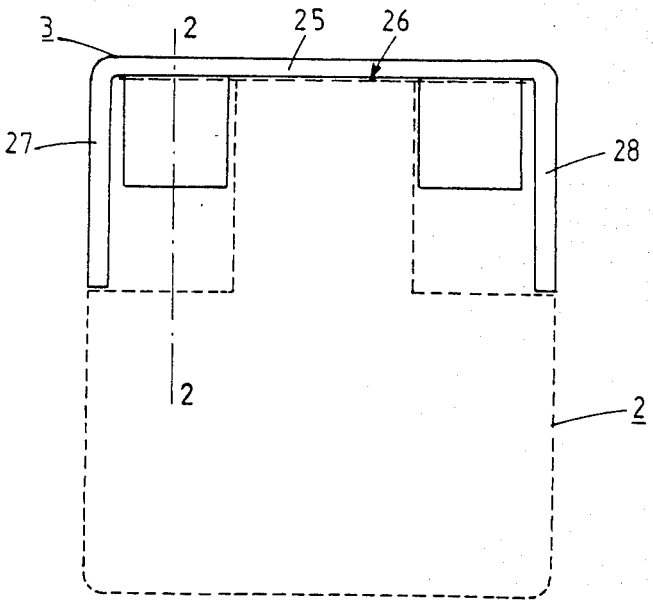
FIG. 6 represents a side section of the cover.

The cover 3 takes the general form of a $\upsilon$-shaped part with an essentially level base 25 which is applied to a frontal side 26 of the casing 2, with two parallel projections 27, 28 (see FIG. 6).

Figure 4:
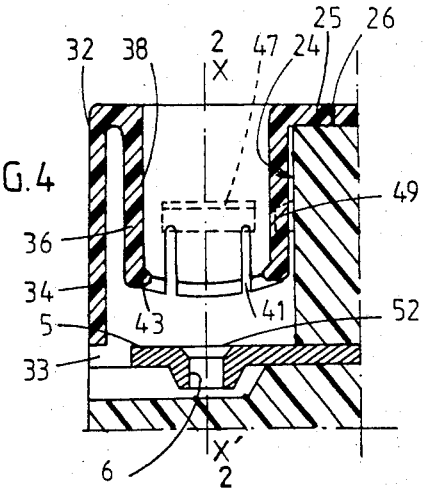
FIG. 4 shows an enlarged partial section through a plane 4—4 of FIG. 1 defined in FIG. 1, but the bolt is missing.

Each projection is divided into the same number of parallel strands such as 29, 30, 31, 32 (see FIGS. 2 and 4), which are inserted in the entrance 33 to each housing through which an exterior conductor will be inserted to make the connection. Each strand has two notches such as 34, 35 to make it possible for the exterior conductor/s to pass through them.

Figure 3:
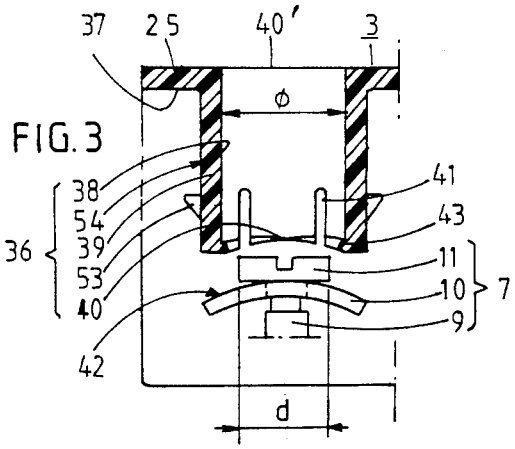
FIG. 3 represents an enlarged section of a portion of the cover sectioned by the plane 2—2 of FIGS. 4 and 6 and inserted in the area of a terminal bolt.

The internal surface 37 of the cover 3 which is parallel to the base 25 has a number of tubular protrusions that are parallel, such as 36 (see FIG. 3). Each contains a cylindrical hole 38 surrounded by a thin wall 39 that can be distorted and two orifices, one internal 40 and one external 40'. The cover has the same number of tubular protrusions and thus the same number of holes as terminals. Said protrusions are placed coaxially to the terminal bolts in the housings when the cover is coupled to the casing. Each wall in the hole preferably has slots 41 parallel to the axis to increase the potential for natural transverse distortion of the wall 39.

On the outside, the internal orifice 40 has a curved shape so that it can rest on the curved surface 42 of a clamp that is oriented toward the bolt head 11 and preferrably has a small flange 43 on the inside, the interior diameter of which is also slightly greater than the diameter d" of the bolt head.

Partitions 16, 17, 18, 19, 20 and/or walls 21, 22, 23, 24 each have a small rib such as 44, 45 or 46, 47 and/or respectively 48, 49 on their internal sides. The rib is inserted tranversely in comparison to an axis such as XX' (see FIGS. 1 and 4).

The ribs are inserted in such a way that they work together with the tubular walls 39 to give them a transverse distortion when the cover is coupled to the casing of the device.

Figure 5:
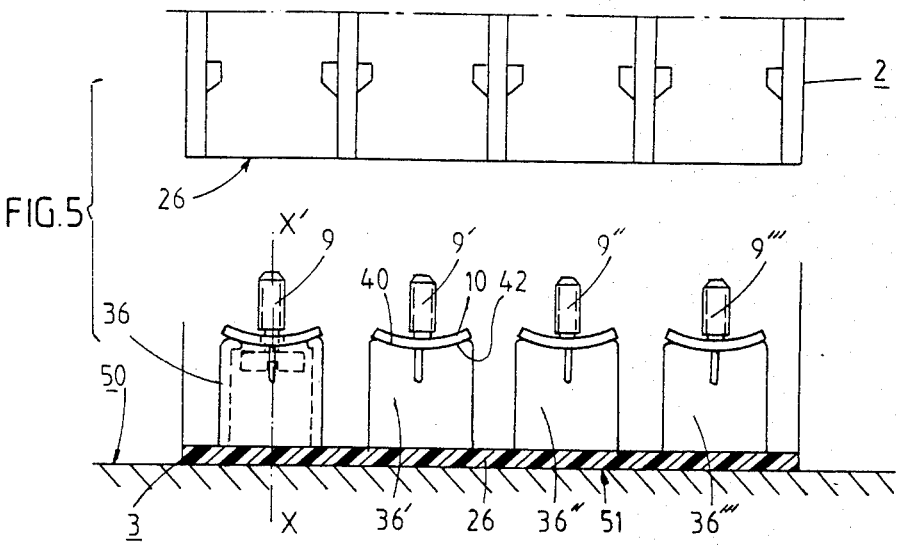
FIG. 5 represents a phase of assembly of the device.

Diameters $\phi$ of the holes such as 38 are slightly greater than diameters d of the bolt heads, which makes it possible to use gravity to insert them into the holes of the tubular protrusions 36, 36', 36", 36'" (see FIG. 5,) when the external side 51 of the cover 3 is placed flat on an appropriate holder 50.

The bolts 9, 9', 9'', 9''' are each parallel to XX' because a surface 42 of a clamp 10 and an orifice 40 work together.

Assembly occurs as a casing 2 moves downward. Its side 26 is turned toward the bottom and this leads the walls such as 39 to work together with the above-mentioned ribs such as 46, 47 or 48 and causes them to become distorted.

The distortions provide a gripping of each of the bolt heads by the walls of the hole that later holds them in an open position so that the terminals can be wired directly, because the threaded tip 8 of the bolt that is not inside the threaded opening 6 is just barely placed in the entrance 52 to said opening (see FIG. 2).

Since the shape of the opening 40 and the clamp 10 work together, the latter is more properly directed.

Holding the cover or anchoring it on the casing can be achieved by any known means and for example, from a rib such as 44 working together with a small flange such as 53 placed on an external surface 54 of the tubular protrusion 36 (see FIG. 3). The elastic holding of the bolt head can be completed by the action that the flange 43 has under the head 11 of the bolt 7.

In a known manner, the terminal is secured by using a screwdriver, inserted in the orifice 40' of the hole 38 and guided by the screwdriver.

We claim:

1. An electrical connection device including a body with plural neighboring housings separated by at least one of partitions and walls parallel to the screwing axes of a number of connection terminals, each of which has an internal fixed conductor with a threaded opening and a set-screw equipped with a clamp that always remains under the head of a bolt; and a protective cover that hooks onto the body and opposite each bolt head has a coaxial cylindrical opening that is able to guide a screwing tool and that maintains the bolt in a pending position where a threaded tip is placed opposite the threaded opening, characterized in that the interior diameter of the cylindrical opening is greater than the diameter of the head of the bolt, the cylindrical opening being surrounded by a thin wall transversely distorted by an exterior surface of the wall working together with a rib carried by a said partition or wall so that the bolt head can be inserted in the cylindrical opening using gravity when the cover is not coupled to a body and can be gripped by the distorted wall when the cover is coupled to the body.

2. Connection device according to claim 1, characterized in that an internal orifice of the cylindrical opening in the area of the head of the bolt has a curved contour that can be applied on a corresponding surface of the clamp oriented toward the head.

3. A connection device according to claim 1, characterized in that the wall of the cylindrical opening has slots that promote transverse distortion.

4. A connection device according to claim 1, characterized in that a small internal flange is placed inside the cylindrical opening having an internal diameter that is slightly greater than the diameter of the head of the bolt.

5. A connection device according to claim 2, characterized in that the wall of the cylindrical opening has slots that promote transverse distortion.

6. A connection device according to claim 2, characterized in that a small internal flange is placed inside the orifice having an internal diameter that is slightly greater than the diameter of the head of the bolt.

7. A connection device according to claim 3, characterized in that a small internal flange is placed inside the cylindrical opening having an internal diameter that is slightly greater than the diameter of the head of the bolt.

8. A connection device according to claim 5, characterized in that a small internal flange is placed inside the orifice having an internal diameter that is slightly greater than the diameter of the head of the bolt.

* * * * *